United States Patent [19]

Kuzukawa et al.

[11] Patent Number: 5,070,315

[45] Date of Patent: Dec. 3, 1991

[54] ELECTROMAGNETIC RELAY

[75] Inventors: Kiyoaki Kuzukawa, Ibaraki; Chikayoshi Kawamura, Yamaga, both of Japan

[73] Assignee: Omron Corporation, Kyoto, Japan

[21] Appl. No.: 528,889

[22] Filed: May 29, 1990

[30] Foreign Application Priority Data

| | | | |
|---|---|---|---|
| May 26, 1989 | [JP] | Japan | 1-61036[U] |
| Jun. 8, 1989 | [JP] | Japan | 1-66998[U] |
| Jun. 8, 1989 | [JP] | Japan | 1-66999[U] |
| Oct. 11, 1989 | [JP] | Japan | 1-119021[U] |

[51] Int. Cl.[5] ..... H01H 50/60

[52] U.S. Cl. ..... 335/128; 335/135

[58] Field of Search ..... 335/128-135, 335/187, 202, 276, 203

[56] References Cited

U.S. PATENT DOCUMENTS

| | | | |
|---|---|---|---|
| 4,193,052 | 3/1980 | Hayden | 335/128 |
| 4,405,911 | 9/1983 | Hasegawa et al. | 335/135 |
| 4,517,537 | 5/1985 | Weiser et al. | 335/203 |

FOREIGN PATENT DOCUMENTS 59-27005 8/1984 Japan .

*Primary Examiner*—Harold Broome

*Attorney, Agent, or Firm*—Fish & Richardson

[57] ABSTRACT

An electromagnetic relay, comprising: an electromagnetic coil; an iron core passed centrally through the electromagnetic core; a yoke having a first end connected to a first end of the iron core; and an L-shaped armature, having a short piece and a long piece connected to each other via a corner portion, pivotally supported by a second end of the yoke at its corner portion so that the short piece may move toward a second end of the iron core by magnetic attraction when the electromagnetic coil is energized and move away from the second end of the iron core by a spring force of spring means when the electromagnetic coil is de-energized. The second end of the yoke may be provided with a part having a locally enlarged cross section to reduce the magnetic resistance at the interface between the armature and the yoke. The short piece of the armature may be provided with a projection near the corner portion which slides along a fixed surface in order to keep the armature resting upon the yoke in a stable fashion.

7 Claims, 5 Drawing Sheets

ELECTROMAGNETIC RELAY

TECHNICAL FIELD

The present invention relates to an electromagnetic relay, and in particular to an electromagnetic relay which is compact in design and reliable in operation.

BACKGROUND OF THE INVENTION

An electromagnetic relay typically consists of an electromagnet block and a contact block. The electromagnet block comprises an iron core, an electromagnetic coil wound around the iron core, a yoke having a first end connected to an end of the core and a second end disposed adjacent to the other end of the iron core, and an armature which can move between a first position to magnetically connect the second end of the yoke and the adjacent end of the iron core, and a second position to open the magnetic connection therebetween. According to a preferred design, the armature consists of a planar member bent into the shape of letter L, having a long piece and a short piece, which rests upon the free end edge of the yoke at its corner portion. The yoke is also formed of a planar member bent into the shape of letter L having a long piece and a short piece.

The magnetic flux conducted through the yoke is then conducted through the short piece of the armature. Since the yoke is typically formed by cutting it out of a planar blank member by means of a punch and die before being bent into the shape of letter L, its edge portion must be properly chamfered appropriately in order to remove burrs and other sources of ruggedness. Therefore, the free end edge of the long piece of the yoke is typically chamfered and the armature rests upon this chamfered free end edge of the yoke, thereby creating a substantially large magnetic resistance.

The armature is also formed from a planar blank member by means of a punch and die, and its edges may have some burrs and other rugged parts. The free end of the long piece of the armature typically bears upon the moveable contact piece of the contact block. Therefore, the uncertainty in the condition of the free end edge of the long piece of the armature could cause a corresponding uncertainty in the stroke of the moveable contact piece.

The armature is typically kept in its pivotally supported position by means of a spring member urging its corner portion against the free end edge of the yoke. Therefore, when an excessive impact is applied to the electromagnetic relay, the supported condition of the armature could become unstable.

Also, the electromagnet block is required to be securely attached to the casing, and this necessitated special securing means, thereby increasing the manufacturing cost.

BRIEF SUMMARY OF THE INVENTION

In view of such problems encountered in designing an electromagnetic relay, a primary object of the present invention is to provide an electromagnetic relay which presents a relatively small magnetic resistance in its magnetic circuit, and is therefore capable of efficient operation.

A second object of the present invention is to provide an electromagnetic relay which has a highly uniform stroke of the movement of its moveable contact and is therefore capable of reliable operation.

A third object of the present invention is to provide an electromagnetic relay in which the armature is pivotally supported in a secure manner without involving any excessive frictional resistance thereto.

A fourth object of the present invention is to provide an electromagnetic relay in which the electromagnet block is fixedly secured in a casing in a simple but reliable manner.

According to the present invention, these and other objects can be accomplished by providing an electromagnetic relay, comprising: an electromagnetic coil; an iron core passed centrally through the electromagnetic core; a yoke having a first end connected to a first end of the iron core; and an L-shaped armature, having a short piece and a long piece connected to each other via a corner portion, pivotally supported by a second end of the yoke at its corner portion so that the short piece may move toward a second end of the iron core by magnetic attraction when the electromagnetic coil is energized and move away from the second end of the iron core by a spring force of spring means when the electromagnetic coil is deenergized; the second end of the yoke being provided with a part having a locally enlarged cross section. According to a preferred embodiment of the present invention, the second end of the yoke is provided with a pair of lateral extensions.

Thereby, an increase in magnetic resistance at the free end edge of the yoke upon which the armature rest is avoided.

According to a certain aspect of the present invention, the short piece of the armature is provided with a projection near the corner portion which slides along a fixed surface. Thereby, the armature is pivotally supported in a secure manner without involving any excessive frictional resistance thereto. The fixed surface may be integrally provided in a flange of a coil spool around which the electromagnetic coil is wound.

An electromagnetic relay typically consists of an electromagent block and a contact block, and the electromagnet may have a casing consisting of a base and a cover which substantially encloses the electromagnet block in cooperation with the cover. In order to securely fix the electromagnet block in the case, the cover may be preferably provided with a rib which bears upon the yoke when the cover is mounted on the base.

According to another aspect of the present invention, the electromagnetic relay further comprises a contact unit including a moveable contact piece carrying a moveable contact which cooperates with a fixed contact; and a stopper projecting from the base to define a position of the armature by engaging a free end portion of the long piece of the armature when the electromagnetic coil is not energized; the long piece of the armature being provided with a projection on its surface facing away from the electromagnetic coil and at a certain distance away from the free end portion of the long piece of the armature for bearing upon the moveable contact piece to effect a switch over of the contact unit.

Since this projection may be formed by stamping or other suitable means separately from the free end edge of the long piece of the armature, it is free from burrs and other ruggedness, and can therefore ensure a prescribed stroke of the contact unit without requiring any special care to be taken during the manufacturing process of the armature. Furthermore, since the projection is positioned slightly away from the free end portion or towards the corner portion of the armature, it can apply a relatively large force upon the moveable contact piece of the contact unit, and this also contributes to the improvement of the reliability of the electromagnetic relay during its operation, and the simplification of the manufacturing process.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
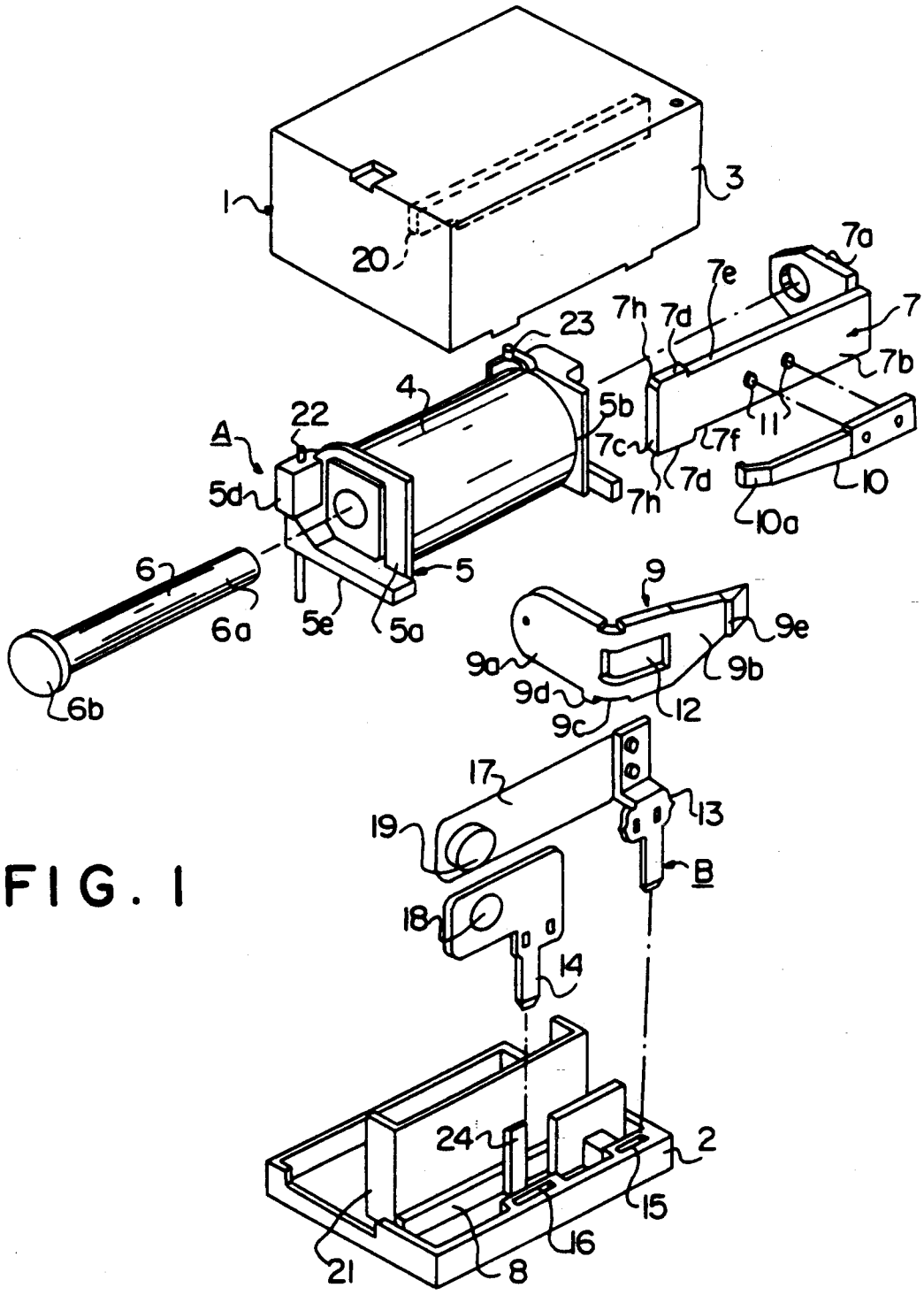
FIG. 1 is an exploded perspective view of a preferred embodiment of the electromagnetic relay according to the present invention.
Figure 2:
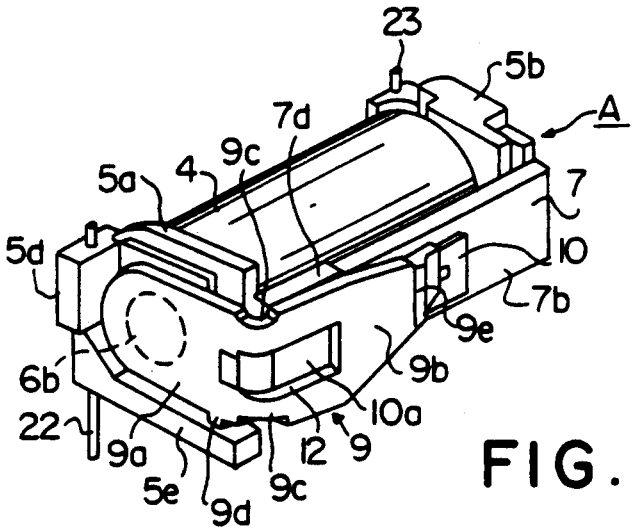
FIG. 2 is a perspective view of the electromagnet block of the electromagnetic relay.

Referring to FIG. 1 showing a preferred embodiment of electromagnetic relay according the present invention, this electromagnetic relay comprises a base 2 and a box-shaped cover 3 which are both made of synthetic resin and jointly define a substantially enclosed casing 1 for this electromagnetic relay. The base 2 supports thereon an electromagnet block A and a contact block B.

Figure 3:
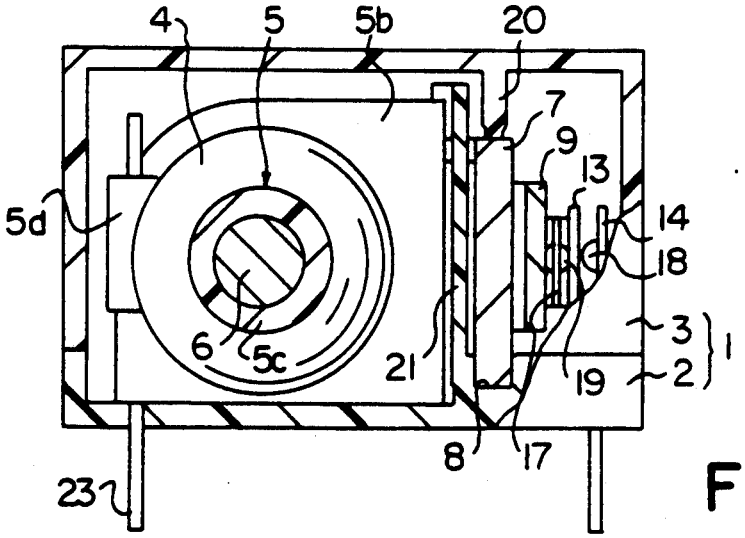
FIG. 3 is a cross sectional view of the electromagnetic realy.
Figure 4:
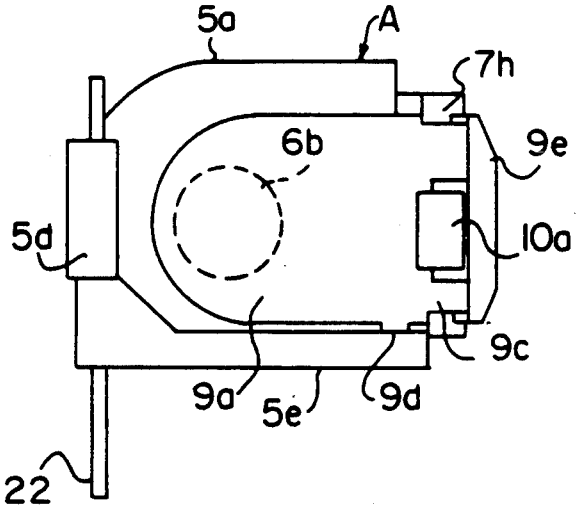
FIG. 4 is an end view of the electromagnetic relay.

The electromagnet block A comprises an electromagnetic coil 4 which is wound around a coil spool 5 having a pair of integral flanges 5*a* and 5*b* on either longitudinal end thereof, and an iron core 6 is passed through the axial center of a tubular central part 5*c* of the coil spool 5 (refer to FIG. 3). One end 6*a* of the iron core 6 is press fitted into an opening provided in a short piece 7*a* of an L-shaped yoke 7, and the other end 6*a* of the core 6 is formed into a radial flange. The long piece 7*b* of the yoke 7 extends along a side of the electromagnetic coil 4, and is received in a groove 8 provided in the base 2. The flanges 5*a* and 5*b* of the coil spool 5 are integrally provided with blocks 5*d* carrying terminal pieces 22 and 23 for the electromagnetic coil 4. Thus, the electromagnet block A substantially consists of the electromagnetic coil 4, the iron core 6 and the yoke 7.

The free end 7*c* of the long piece 7*b* of the yoke 7 pivotally supports an L-shaped armature 9 which consists of a short piece 9*a* adapted to be moved toward and away from the other end (magnetic pole) 6*b* of the iron core 6, a long piece 9*b* extending along the long piece 7*b* of the yoke 7, and a corner portion 9*c* which rests upon the free end 7*c* of the long piece 7*b* of the yoke 7 and is provided with a rectangular opening 12. The long piece 9*b* is provided with a projection 9*e* on its surface facing away from the electromagnetic coil 4 and at some distance from the free end of the long piece 9*b*. A sheet metal spring 10 is secured to the long piece 7*b* of the yoke 7 by rivets 11 at its base end, and is passed through the rectangular opening 12 and bears upon the corner portion 9*c* of the armature 9 at its free end 10*a*. The flange 5*a* of the spool 5 is provided with a block 5*e* and the short piece 9*a* of the armature 9 is provided with a projection 9*d*, near its corner portion 9*c*, which is in sliding engagement with the surface of the block 5*e*.

A pair of terminal pieces 13 and 14 are press fitted into slots 15 and 16, respectively, provided in the base 2. One of the terminal pieces 13 carries a moveable contact piece 17 provided with a moveable contact 19, and the other terminal piece 14 carries a fixed contact 18 which cooperates with the moveable contact 19. Thus, the contact block B substantially consists of the terminal pieces 13 and 14, the moveable contact piece 17, and the fixed and moveable contacts 18 and 19.

The inner surface of the upper wall of the cover 3 is provided with a rib 20 extending in parallel with the longitudinal line of the electromagnet block A, and is adapted to be pressed against the upper side edge 7*e* of the yoke 7. A vertical wall 21 is integrally provided in the base 2 to separate the electromagnetic coil 4 from the yoke 7, the armature 9 and the contact block B. The base 2 is further integrally provided with a stopper 24 which defines the position of the armature 9 when the electromagnetic coil 4 is not energized as described hereinafter.

Now the mode of operation of this electromagnetic relay is described in the following.

When the electromagnetic coil 4 is energized, and the iron core 6 is magnetized, the magnetic flux $\phi$ conducted through the yoke 7 is then conducted through the short piece 9*a* of the armature 9, and the short piece 9*a* of the armature 9 is thereby attracted to the magnetic pole 6*a* of the iron core 6. As a result, the armature 9 rotates around its corner portion 9*c*, and bears upon the moveable contact piece 17 at its projection 9*e*. The moveable contact piece 17 is thereby deflected and causes the moveable contact 19 to come into contact with the fixed contact 18.

During the rotational motion of the armature 9, its projection 9*d* slides over the surface of the block 5*e* of the coil spool 5. Since the projection 9*d* has a small area of contact and is located near the corner portion 9*c* or the pivot center of the armature 9, it creates a relatively small frictional resistance but significantly contributes to keeping the armature 9 pivotally supported by the yoke 7 even when the electromagnetic relay encounters excessive impacts and vibrations.

When the electromagnet 4 is de-energized, the armature 9 returns to its original position under the spring force of the moveable contact piece 17, and the moveable contact 19 moves away from the fixed contact 18.

Figure 8:
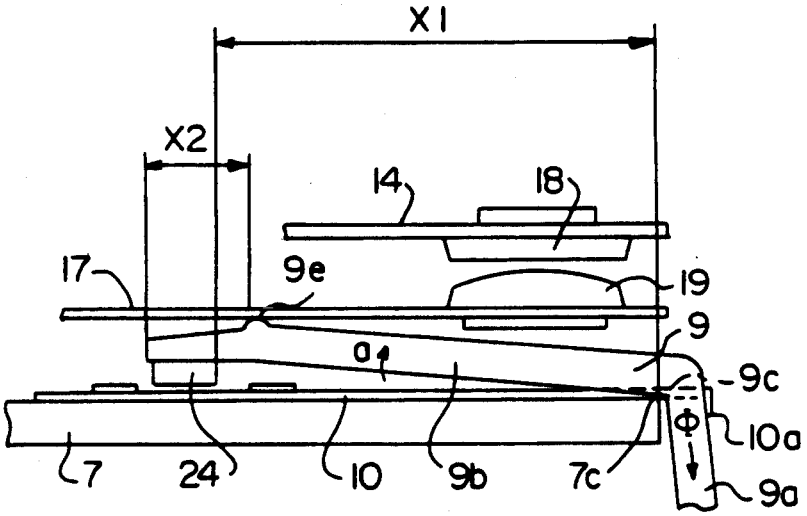
FIG. 8 is an enlarged view of the armature and the moveable contact piece of the electromagnetic relay according to the present invention.
Figure 9:
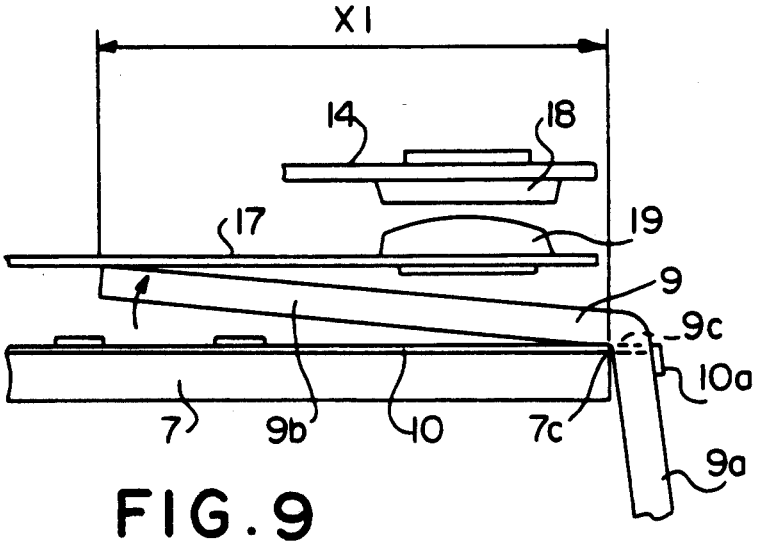
FIG. 9 is an enlarged view of the armature and the moveable contact piece of the related art electromagnetic relay.

According to the present invention, the de-energized state of the armature 9 is defined by the engagement between the stopper 24 and a free end portion of the long piece 9*b* of the armature 9 whereas the projection 9*e* for acting upon the contact block B is provided at a certain distance (indicated by distance X2 in FIG. 8) from the free end portion of the long piece 9*b* as best illustrated in FIG. 8. Therefore, since the rotative movement of the armature 9 is enlarged at the free end portion, the de-energized position of the armature 9 is accurately defined by the stopper 24. This can be better understood by referring to FIG. 9 which shows a corresponding structure of the related art electromagnetic relay in which the armature 9 acts upon a contact block B and a stopper at a common point as indicated by distance X1 from its pivot point. As for the projection 9e, since it is formed by stamping or other suitable means separately from the free end edge of the long piece 9b of the armature 9, it is free from burrs and other ruggedness, and can therefore ensure a prescribed stroke of the contact unit without requiring any special care to be taken during the manufacturing process of the armature 9. Furthermore, since the projection 9e is positioned slightly away from the free end portion or towards the corner portion 9c of the armature (the distance between the projection 9e and the pivot point of the armature 9 is indicated by distance X1 in FIG. 8), it can apply a relatively large force upon the contact unit B, and this also contributes to the improvement of the reliability of the electromagnetic relay during its operation, and the simplification of the manufacturing process.

According to the present invention, the free end of the long piece 7b of the yoke 7 is provided with a pair of lateral extensions 7e on either side thereof. Therefore, the width of the yoke 7 is generally given by d, but is made locally wider in the free end portion of the long piece 7b as indicated by the width W (refer to FIG. 5). This is advantageous in reducing the overall magnetic resistance of the magnetic circuit of this electromagnet block A. The yoke 7 is made of a planar blank member by using a punch and die, and is therefore required to be chamfered or rounded in corner portions as indicated by numeral 7h. Typically, the corners 7h one either side of the free end edge of the long piece 7b of the yoke are required to be chamfered, and these chamfered portions 7h formed parts which present a relatively high magnetic resistance. Therefore, according to this invention, the free end of the long piece 7b of the yoke is provided with the lateral extensions 7d, and the local increase in magnetic resistance is avoided.

Figure 5:
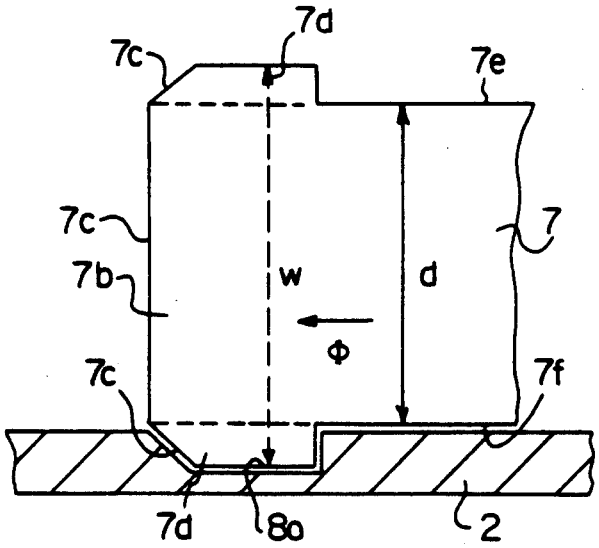
FIG. 5 is an enlarged view of a free end portion of the yoke.
Figure 6:
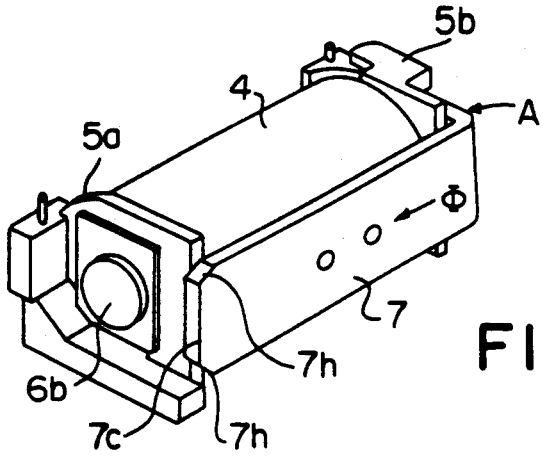
FIG. 6 is a perspective view of an electromagnet block of a related art electromagnetic relay.

Since the lower edge 7f of the yoke 7 is received in the groove 8 of the base 2 having a complementary shape as shown in FIG. 5, and the rib 20 of the case 3 bears upon the upper edge 7e of the yoke 9, the yoke 9 is securely held between the base 2 and the cover 3. The bottom surface of the groove 8 is provided with a recess 8a for receiving one of the lateral extensions 7d, and the projection 20 in the cover is also provided with a similar recess. Therefore, the electromagnet block A is securely fixed in the casing 1, and this ensures a proper positional relationship between the electromagnet block A and the contact unit B even when the electromagnetic relay is subjected to impacts and vibrations. Also, the recess 8a offers the additional advantage of restricting the longitudinal movement of the yoke 7.

Figure 7A:
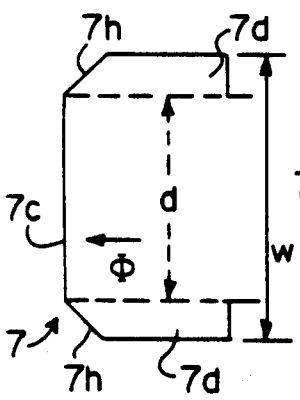
FIGS. 7(*a*) through 7(*c*) are enlarged views of free end portions of different embodiments of the yoke.
Figure 7B:
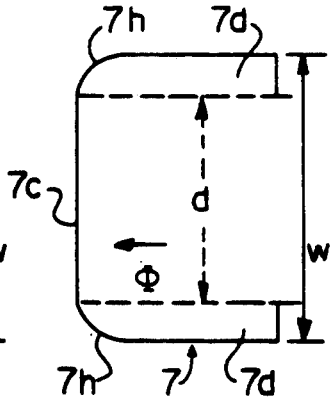
Figure 7C:
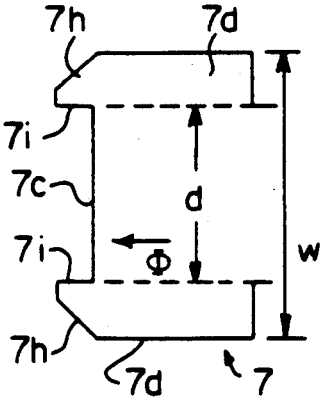

According to the above described embodiment, the increase in the magnetic resistance can be compensated for by increasing the cross sectional area of the free end of the yoke, and it can be accomplished also by increasing its thickness instead of providing lateral extensions. Also, the corner portions of the free edge of the yoke may be rounded as shown in FIG. 7(b). If desired, the free end edge of the yoke 7 may be provided with a recess 7i to receive the corner portion of the armature therein as shown in FIG. 7(c). In the above description, the armature and the yoke are each described as comprising a long piece and a short piece, but as can be readily understood by a person skilled in the art their actual relative dimensions may be opposite to their names (the long piece may be in reality shorter than the short piece) depending on the particular design.

Although the present invention has been described in terms of specific embodiments, it is possible to modify and alter details thereof without departing from the spirit of the present invention.

What we claim is:

1. An electromagnetic relay, compromising:

an electromagnetic coil having flanges at longitudinal ends thereof;

an iron core passed centrally through said electromagnetic core;

a yoke having a first end connected to a first end of said iron core;

an L-shaped armature, having a short piece and a long piece connected to each other via a corner portion, pivotally supported by a second end of said yoke at its corner position so that said short piece may move toward a second end of said iron core by magnetic attraction when said electromagnetic coil is energized and move away from said second end of said iron core by a spring force of spring means when said electromagnetic coil is de-energized;

said second end of said yoke comprising a pair of upper edge and lower edge lateral extensions separated by a first width, and further comprising a free end portion positioned adjacent one of said flanges of said electromagnetic coil comprising a second width larger than said first width; and a supporting base comprising groove means for receiving a lateral extension of said yoke second end.

2. An electromagnetic relay according to claim 1, wherein said base is provided with a groove for receiving one side of said yoke, said groove being provided with a shape which is complementary to the side of said yoke received by said groove.

3. An electromagnetic relay, comprising:

an electromagnetic coil comprising an extended block surface at one end thereof;

an iron core passed centrally through said electromagnetic core;

a yoke having a first end connected to a first end of said iron core; and an L-shaped armature, having a short piece and a long piece connected to each other via a corner portion, pivotally supported at said corner portion by a second end of said yoke so that said short piece may move toward a second end of said iron core by magnetic attraction when said electromagnetic coil is energized and move away from said second end of said iron core by a spring force of spring means when said electromagnetic coil is de-energized;

said short piece of said armature being provided with a projection near said corner portion which slides along said extended block surface at one end of said electromagnetic coil.

4. An electromagnetic relay according to claim 3, wherein said fixed surface is integrally provided in a flange of a coil spool around which said electromagnetic coil is wound.

5. An electromagnetic relay according to claim 3, further comprising a base for mounting thereon an electromagnet block including said electromagnetic coil, said iron core, said yoke and said armature, and a cover which substantially encloses said electromagnet block in cooperation with said cover, said cover being provided with a rib which bears upon said yoke when said cover is mounted on said base.

6. An electromagnetic relay according to claim 5, wherein said base is provided with a groove for receiving a part of said yoke.

7. An electromagnetic relay, comprising:

an electromagnetic coil;

an iron core passed centrally through said electromagnetic core;

a yoke having a first end connected to a first end of said iron core;

an L-shaped armature, having a short piece and a long piece connected to each other via a corner portion, pivotally supported by a second end of said yoke at its corner portion so that said short piece may move toward a second end of said iron core by magnetic attraction when said electromagnetic coil is energized and move away from said second end of said iron core by a spring force of spring means when said electromagnetic coil is de-energized;

a contact unit including a moveable contact piece carrying a moveable contact which cooperates with a fixed contact; and a base having a stopper projecting from said base to define a position of said armature by engaging a free end portion of said long piece of said armature when said electromagnetic coil is not energized;

said long piece of said armature being provided with a projection on its surface facing away from said electromagnetic coil and at a certain distance away from said free end portion of said long piece of said armature for bearing upon said moveable contact piece to effect a switch over of said contact unit.

* * * * *